United States Patent [19]

Lakra

[11] 4,019,481

[45] Apr. 26, 1977

[54] FUEL INJECTION SYSTEMS

[75] Inventor: Paul Lakra, Wembley, England

[73] Assignee: C.A.V. Limited, Birmingham, England

[22] Filed: Mar. 4, 1976

[21] Appl. No.: 663,852

[30] Foreign Application Priority Data

Mar. 7, 1975 United Kingdom ..... 9519/75

[52] U.S. Cl. ..... 123/139 E

[51] Int. Cl.[2] ..... F02M 51/00

[58] Field of Search ..... 123/139 E

[56] References Cited

UNITED STATES PATENTS

| | | | |
|---|---|---|---|
| 3,587,547 | 6/1971 | Hussey | 123/139 E |
| 3,961,612 | 6/1976 | Okamoto | 123/139 E |

*Primary Examiner*—Robert G. Nilson

[57] ABSTRACT

A fuel injection system includes a piston movable within a bore to displace fuel through a fuel outlet. Fluid under pressure can be admitted to the other end of the bore by way of a valve means to effect movement of the piston to displace fuel and when the valve means is closed a further valve means can be opened to permit the piston to move in the opposite direction. The valve means and the further valve means are actuated by a control pressure generated by a stack of piezo-electric crystals. The valve means 23 includes a plurality of pressure balanced pistons and when the stack of crystals is de-energised the valve means is in the closed position.

12 Claims, 2 Drawing Figures

FUEL INJECTION SYSTEMS

This invention relates to fuel injection systems for supplying fuel to internal combustion engines, the systems comprising an accummulator in which fuel is stored at a high pressure, pump means for charging the accumulator with fuel, a piston slidable within a cylinder, a fuel outlet from one end of the cylinder, said fuel outlet in use communicating with the inlet of an injection nozzle of the engine, valve means operable to place the other end of the cylinder in communication with said accumulator when it is desired to deliver fuel to the engine, said valve means when open allowing fuel to flow from the accumulator to said other end of the cylinder to cause displacement of said piston thereby to expel fuel from said one end of the cylinder, a stack of piezo electric crystals arranged when energised to generate a control pressure which is applied to a second piston forming part of said valve means to operate said valve means and an electrical control network for controlling the operation of said stack of crystals in timed relationship with the associated engine.

One of the problems with such a system is that if it is required to obtain an increased flow rate through the valve means, the volume of liquid required to be generated at the control pressure must be increased. In order to achieve this it is necessary to increase the size of the stack of crystals and this presents practical difficulties so far as accommodating the crystals are concerned, and also presents difficulties in so far as providing additional electrical energy to energise the crystals.

The object of the invention is to provide such a system in a simple and convenient form.

According to the invention, in a system of the kind specified, said valve means comprises a second cylinder, said second piston being slidably located in said cylinder, a valve head connected to said second piston by a portion of reduced cross sectional area as compared with the piston, a valve seating for co-operation with said head, an outlet from said second cylinder intermediate the piston and the valve head, said outlet being connected to said other end of said first mentioned cylinder, said valve head being exposed to the pressure of fuel within the accumulator so that the valve head is forced onto the seating by the pressure of fuel within the accumulator, a third cylinder, a third piston slidable within said third cylinder, said third piston engaging said second piston, a fourth cylinder and a fourth piston within said fourth cylinder, said fourth piston engaging said third piston and at its end remote from said third piston being subjected to the fuel pressure within said accumulator, the area of said second and fourth pistons being substantially equal and also substantially equal to the seat area of the valve head, the area of said third piston being less than that of the fourth piston, said control pressure being applied to the presented faces of said second and third pistons and means for supplying a backing pressure to the presented faces of said third and fourth pistons, the control pressure when the stack of crystals is energised, being higher than said backing pressure but falling to a value less than the backing pressure when the crystals are de-energised, the arrangement being such that upon energisation of the crystals, the valve head will be moved away from the seating to permit flow of fuel from the accumulator to said first mentioned cylinder.

One example of a fuel injection system in accordance with the invention will now be described with reference to the accompanying drawings, in which.

Figure 1:
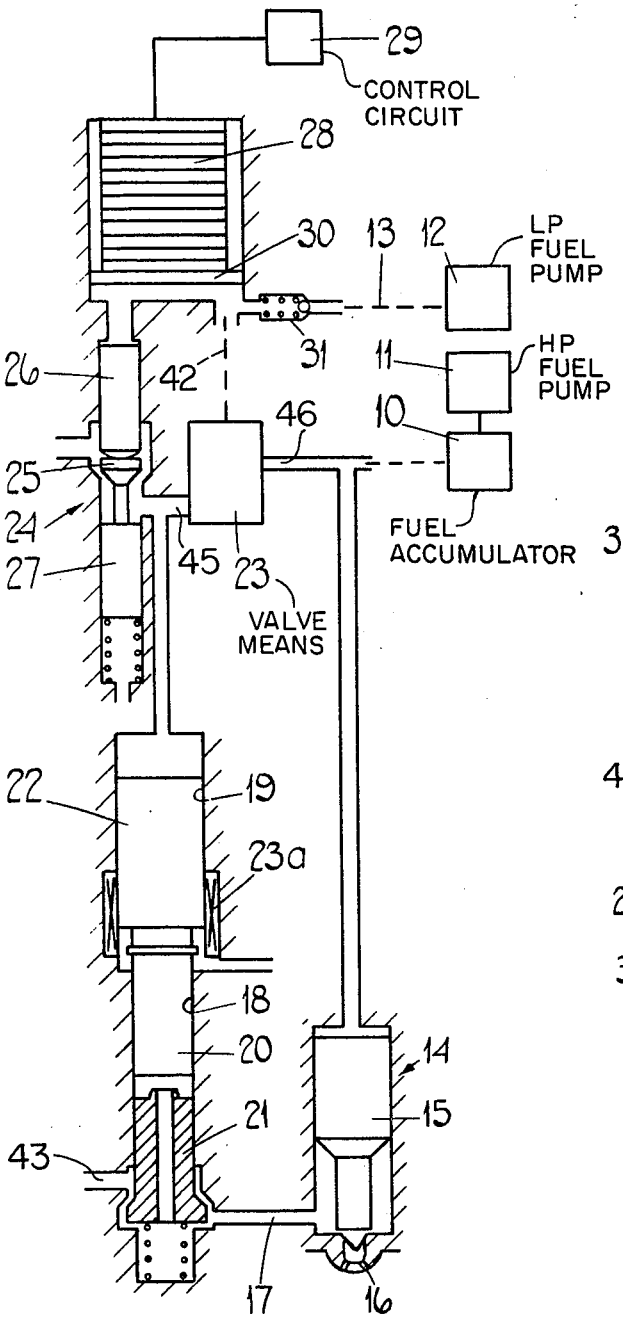
FIG. 1 shows in diagrammatic outline, the system.

Referring to FIG. 1 of the drawings, there is provided an accumulator 10 in which fuel at high pressure is contained, the fuel being supplied to the accumulator by means of a high pressure pump 11. Also provided is a low pressure pump 12 having an outlet 13. The pumps 11 and 12 are driven by the engine with which the apparatus is associated and operate continuously. Also shown in FIG. 1 is a fuel injection nozzle 14 which comprises a valve member 15 slidable within a bore, the valve member 15 being of stepped form and the narrower end of the valve member co-operating with a seating which controls the flow of fuel through orifices indicated at 16, to a combustion space of the associated engine. The wider end of the valve member 15 is connected to the outlet of the accumulator 10 and the differential area of the valve member 15 can be subjected to a pressure of fuel which is higher than that of the accumulator pressure, through a pipe 17 communicating with the inlet of the injection nozzle.

The system includes a bore 18 which is co-axial with a further bore 19 of larger diameter. Within the bore 18 there is located a piston 20 and the end of the bore 18 remote from the bore 19 communicates with the pipe 17. Also accommodated within the bore 18 is a valve member 21 having a through drilling by which the pipe 17 is placed in constant communication with the bore 18. The valve member has a head portion which can co-operate with a seating, the head portion and seating being of larger diameter than the remaining portion of the valve member. The annular space defined at the end of the bore 18 underneath the valve head and seating communicates with the outlet 13 of the low pressure pump 12 by way of a passage 43. The valve member is spring loaded by means of a coiled compression spring into contact with the seating.

The bore 19 accommodates a piston 22 which is in engagement with the piston 20 and the piston 22 is of larger diameter than the piston 20, the annular space defined by the two pistons and the bore 19 communicating with a drain. Moreover, the piston 20 is provided with a magnetic element which co-operates with a sensing winding 23 to provide an indication of the position of the pistons 20 and 22.

The end of the bore 19 remote from the bore 18 can be placed in communication with the accumulator 10 by way of valve means 23 or with a drain by way of a valve means 24. The valve means 24 comprises a valve head 25 which is movable into contact with a seating by means of a pressure operated plunger 26. Moreover, connected to the valve head is a further plunger 27 the action of which is to pressure balance the valve head 25. The valve 24 is spring loaded to the open position in which it is shown.

For actuating the plunger 26 and also the equivalent part of the valve means 23, there is provided a stack 28 of piezo electric crystals and the energisation of these crystals is controlled by a control curcuit 29 which is supplied with signals representing the position of the rotating parts of the engine and also with signals representing the actual engine speed and the demanded engine speed. In addition, the control circuit is provided with a signal indicative of the position of the pistons 20 and 22 from the coil 23. The stack of crystals 28 when energised effects movement of a piston 30 to generate a control pressure which is applied to the plunger 26 and the valve means 23, and when so energised the valve means 24 will be closed and the valve means 23 opened. Moreover, the space in which the control pressure is generated is in communication with the outlet 13 of the low pressure pump 12 by way of a spring loaded non-return valve 31 and this valve can open when the crystals are in the relaxed state to make up any loss of fluid from said space.

In operation, when the stack of crystals 28 is fully energised the valve means 24 is closed and the valve 23 is opened, and fuel from the accumulator acts on the piston 22 to effect movement of the piston 22 and the piston 20 and fuel is displaced from the bore 18 and flows by way of the pipe 17 to act on the valve member 15 of the injection nozzle. Because the piston 22 is larger in diameter than the piston 20, the pressure of fuel supplied to the valve member is higher than that of the accumulator, and the valve member 15 therefore is lifted from its seating so that fuel is supplied to the engine. During continued movement of the pistons 22 and 20, the latter piston engages with the valve member 21 and lifts it from its seating, and the effect of such movement is to terminate the injection of fuel to the engine, the surplus fuel leaving the bore 18 flowing to the outlet of the low pressure pump. At the same time that the pressure in the pipe 17 is lowered, the valve element 15 moves quickly into contact with its seating under the action of the pressure from the accumulator 10.

The stack of crystals 28 is then de-energised, and the effect of this is to cause closure of the valve means 23, and opening of the valve means 24. When this occurs, fuel from the low pressure pump 12 lifts the valve member 21 from its seating and allows fuel to flow into the bore 18, thereby causing movement of the pistons 20 and 22, the fuel which is displaced from the bore 19 flowing by way of the valve means 24 to a drain. Such movement is allowed to continue until a signal is obtained from the coil 23 indicating that sufficient fuel has entered the bore 18, and when such a signal is received the stack of crystals is partially energised to an extent to effect closure only of the valve means 24. The system then rests in that state until the next injection of fuel is required when the stack of crystals 28 is fully energised to create the aforesaid control pressure which opens the valve means 23.

Figure 2:
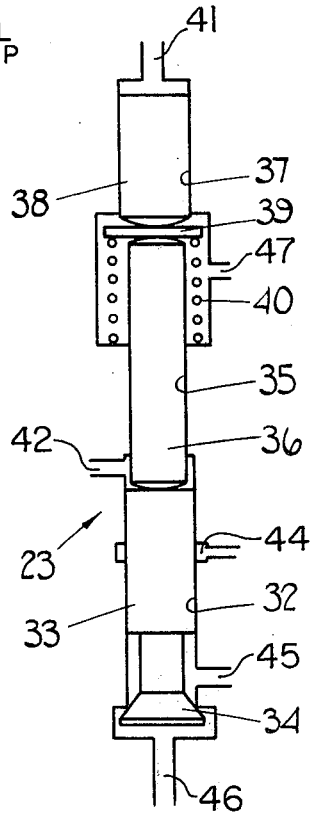
FIG. 2 shows in greater detail part of the system shown in block form in FIG. 1.

Turning now to FIG. 2 which shows in greater detail the valve means 23.

The valve means 23 includes a so called second cylinder 32 having a groove 44 intermediate its ends which is connected to a drain. Mounted within the second cylinder is a so called second piston 33 which is connected to a valve head 34 by a portion of reduced cross sectional area. The valve head 34 co-operates with a seating defined at the end of the cylinder 32 and the portion of the cylinder intermediate the piston 33 and the valve head 34 communicates by way of a passage 45 with the end of the bore 19. Moreover, the valve head 34 extends into a chamber which is in communication with the accumulator 10 by way of a passage 46. The area of the piston 33 is equal to the seat area of the valve head 34, i.e. that area which lies within the seating, and the arrangement is such that the accumulator pressure tends to urge the head 34 into contact with the seating so that no flow of fuel occurs from the accumulator to the bore 19.

Also provided is a third cylinder 35 in which is accommodated a third piston 36, the piston 36 having a rounded end portion engaging the piston 33. The area of the piston 36 is less than that of the piston 33, and the control pressure is applied to the presented faces of the two pistons the pressure being supplied through a passage 42. Also provided is a fourth cylinder 37 and slidable within the fourth cylinder is a fourth piston 38, the area of which is substantially equal to the area of the piston 33. Interposed between the pistons 36 and 38 is a spring abutment 39 for a coiled compression spring 40 which acts to urge the piston 38 away from the piston 35. The faces of the pistons which are presented to the abutment plate 39 are curved, and a passage 47 is provided communicating with the outlet 13 of the low pressure pump 12 so that the pressure developed by this pump can act on the two pistons. The other end of the piston 38 is subjected to the pressure within the accumulator 10 which is supplied to the cylinder 37 by way of a passage 41.

The control pressure which is developed when the stack of crystals 28 is fully energised is greater than the pressure at the outlet 13 of the low pressure pump 12. However, when the stack of crystals is de-energised it is lower than the pressure developed at the outlet 13 of the low pressure pump by an amount substantially equal to the pressure drop across the one way valve 31.

In use, the forces generated by the pressure from the accumulator acting on the various components of the valve means are substantially balanced at all times since the areas of the piston 38, the piston 33 and the valve head 34 are substantially equal. The effect is therefore that when the control pressure is below the pressure at the outlet of the supply pump 13, the various components will assume the position in which they are shown in FIG. 2. When the control pressure is raised, however, to above the pressure at the outlet 13, the unbalance of forces created causes movement of the various components in the downward direction thereby to permit fuel from the accumulator to flow to the bore 19. The purpose of the spring 40 is to ensure that the control pressure must rise to a certain value before opening of the valve means occurs.

The arrangement of the valve means 23 is such that a comparatively small volume of fuel is required to effect opening of the valve means, and it should be remembered that at no time do the pistons 33, 35 and 38 separate from each other. The increase in volume therefore of the space to which the control pressure is applied is very much smaller than would be the case for instance, if a simple plunger were utilised as with the valve means 24. It is possible therefore with this construction to utilise a comparatively small stack of piezo electric crystals which thereby simplifies the accommodation of the crystals and reduces the amount of electrical power which would otherwise be required to energise the crystals.

I claim:

1. A fuel injection system for supplying fuel to internal combustion engines, the system comprising an accumulator in which fuel is stored at a high pressure, pump means for charging the accumulator with fuel, a piston slidable within a cylinder, a fuel outlet from one end of the cylinder, said fuel outlet in use communicating with the inlet of an injection nozzle of the engine, valve means operable to place the other end of the cylinder in communication with said accumulator when it is desired to deliver fuel to the engine, said valve means when open allowing fuel to flow from the accumulator to said other end of the cylinder to cause displacement of said piston thereby to expel fuel from said one end of the cylinder, a stack of piezo electric crystals arranged when energised to generate a control pressure which is applied to a second piston forming part of said valve means to operate said valve means, an electrical control network for controlling the operation of said stack of crystals in timed relationship with the associated engine, said valve means comprising a second cylinder, said second piston being slidably located in said cylinder, a valve head connected to said second piston by a portion of reduced cross sectional area as compared with the piston, a valve seating for co-operation with said head, an outlet from said second cylinder intermediate the piston and the valve head, said outlet being connected to said other end of said first mentioned cylinder, said valve head being exposed to the pressure of fuel within the accumulator so that the valve head is forced onto the seating by the pressure of fuel within the accumulator, a third cylinder, a third piston slidable within said third cylinder, said third piston engaging said second piston, a fourth cylinder and a fourth piston within said fourth cylinder, said fourth piston engaging said third piston and at its end remote from said third piston being subjected to the fuel pressure within said accumulator, the area of said second and fourth pistons being substantially equal and also substantially equal to the seat area of the valve head, the area of said third piston being less than that of the fourth piston, said control pressure being applied to the presented faces of said second and third pistons and means for supplying a backing pressure to the presented faces of said third and fourth pistons, the control pressure when the stack of crystals is energised, being higher than said backing pressure but falling to a value less than the backing pressure when the crystals are de-energised, the arrangement being such that upon energisation of the crystals, the valve head will be moved away from the seating to permit flow of fuel from the accumulator to said first mentioned cylinder.

2. A system according to claim 1 including a pump for supplying said backing pressure.

3. A system according to claim 2 including resilient means for developing a force opposing movement of the second, third and fourth pistons by the control pressure.

4. A system according to claim 3 in which said resilient means comprises a coiled compression spring acting against an abutment disposed intermediate the third and fourth pistons.

5. A system according to claim 4 including an inlet to said one end of the first mentioned cylinder said inlet communicating with a source of fuel and a valve operable to permit fuel to flow into said one end of the further cylinder when said valve means is closed.

6. A system according to claim 5 including further valve means operably by said control pressure, said further valve means when said stack of crystals is de-energised allowing said first mentioned piston to move away from said one end of the cylinder under the action of fuel under pressure flowing into said one end of the first mentioned cylinder.

7. A system according to claim 6 in which said pump is a fuel pump and constitutes said source of fuel.

8. A system according to claim 7 including a piston movable by said stack of crystals to generate said control pressure.

9. A system according to claim 6 in which said further valve means is operable by said first mentioned piston during its movement towards said one end of the cylinder to terminate delivery of fuel through the said fuel outlet.

10. A system according to claim 9 including a fuel injection nozzle containing a differential valve movable by fuel under pressure from said fuel outlet, to an open position.

11. A system according to claim 10 in which said first mentioned cylinder is a stepped cylinder, the narrower portion of said stepped cylinder containing said first mentioned piston, the wider portion of the cylinder containing an actuating piston engaging said first mentioned piston, whereby the pressure developed at said fuel outlet can be greater than the pressure of fuel within the accumulator.

12. A system according to claim 11 in which said differential valve is urged to the closed position by fuel under pressure from the accumulator.

* * * * *